US005704163A

United States Patent [19]

Kocznar

[11] Patent Number: 5,704,163

[45] Date of Patent: Jan. 6, 1998

[54] TURNSTILE

[75] Inventor: Wolfram Kocznar, Innsbruck, Austria

[73] Assignee: Skidata Computer Gesellschaft m.b.H., Gartenau, Austria

[21] Appl. No.: 545,653

[22] PCT Filed: May 3, 1994

[86] PCT No.: PCT/AT94/00056

§ 371 Date: Jan. 4, 1996

§ 102(e) Date: Jan. 4, 1996

[87] PCT Pub. No.: WO94/25720

PCT Pub. Date: Nov. 10, 1994

[30] Foreign Application Priority Data

May 3, 1993 [AT] Austria ..... 857/93

[51] Int. Cl.[6] ..... E06B 11/08

[52] U.S. Cl. ..... 49/47; 49/46

[58] Field of Search ..... 49/46, 47, 13, 49/35, 42

[56] References Cited

FOREIGN PATENT DOCUMENTS 389736 1/1990 Austria .

623112 5/1981 Switzerland .

9303251 2/1993 WIPO .

OTHER PUBLICATIONS

A. S. Zyuzin, "Automated Check point Turnstile." Soviet Patent Abstracts, SU 1476–507A, Mar. 28, 1990 (Derwent Publications Ltd.).

*Primary Examiner*—Blair Johnson
*Assistant Examiner*—Curtis Cohen
*Attorney, Agent, or Firm*—Lorusso & Loud

[57] ABSTRACT

In a turnstile with a housing, a drive shaft and barrier arms projecting therefrom at offset angles, after the right of entry of a passing user has been checked, a drive motor is started up contactlessly in order to rotate the turnstile from the blocking position of a barrier arm to a subsequent narrow-angle stop position. The approach of the user to the barrier arm in the stop position is recognized by an electro-optical sensor which is arranged behind the barrier arm in the direction of passage when in the blocking position in order to rotate the turnstile contactlessly into the next blocking position.

8 Claims, 2 Drawing Sheets

TURNSTILE

Figure 1:
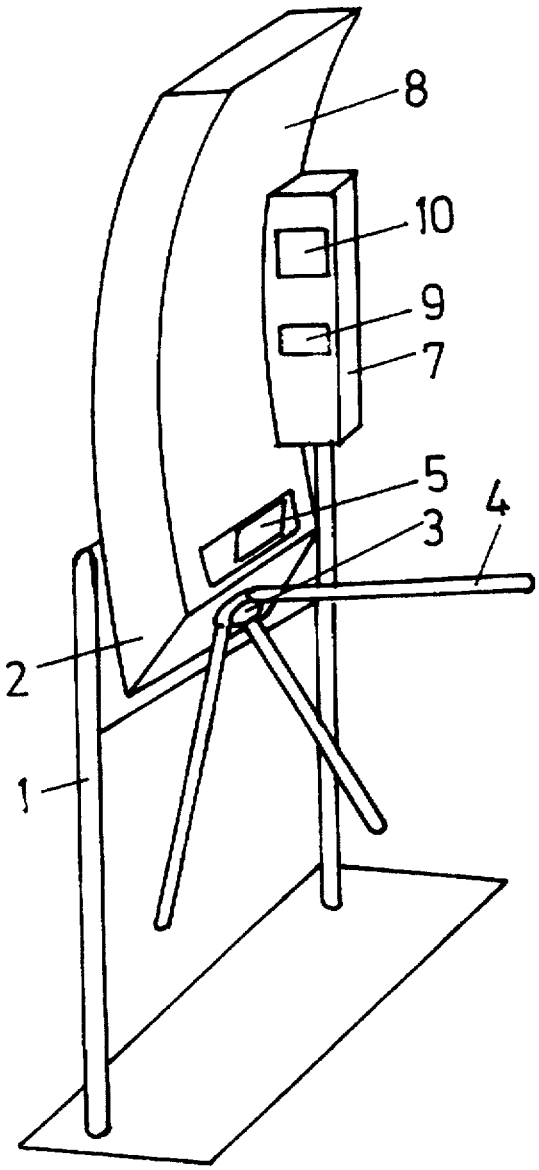

This is a 371 continuation of international application No. PCT/AT94/00056 filed Mar. 4, 1994, now international patent number WO 94/25720.

The invention concerns a turnstile with a housing, a drive shaft and barrier arms coming off it, offset at an angle, each of which extends in the blocking position approximately at right angles to the direction of passage, with a drive motor, which can be set in motion without contact, especially after checking the right of entry of a passing user, in order to turn the next barrier arm of the turnstile into the blocking position, as well as a process for controlling it.

Such a turnstile can be inferred from AT-B 389 736, for example. Proximity sensors, not explained in greater detail, with a switching distance of approximately 5 cm recognize the presence and speed of the person passing and set the drive motor in motion, so that the turnstile is driven at a speed adjusted to the speed of passage. Since each barrier arm must be equipped with a proximity sensor, and the signals emitted by the respective sensor must be transmitted via the rotating shaft into the housing, the design is relatively complicated and problem-prone.

From SU-A 1-476 507, a turnstile is known in which a network of light beams is formed under the cone described by the barrier arms which complements the turnstile. The turnstile has a brake, whereby the turnstile can be locked in any position desired, wherein no certain blocking position must be determined, since the network of light beams recognizes an unauthorized passage in every case.

The task of the invention is to create a simpler design and greater operating safety for a turnstile that goes on when an authorized passerby approaches.

The invention achieves this by assigning an optical electronic sensor to the area of the blocking position.

As soon as the user walks into the detection range of the optical electronic sensor, which preferably covers an angle of 20° maximum, the turnstile drive is turned on. The sensor is installed above and below the drive shaft in the housing, so that the signal can be transmitted to control the motor in the usual way over permanent lines.

One preferred embodiment provides for the optical electronic sensor to have at least one light scanner that responds to reflective changes in a beam of light emitted and that is equipped with a filter for outside light or background. The detection beam emitted is reflected by the passing user. The reflected light hits the first light receiver, which compares the portion of light received with that portion of light that is reflected on a second light receiver from the background further away. Since the positions of both light receivers are adjustable, the range of the detection beam can be limited by determining the distance between its point of intersection and the reflective beam of the second light receiver. This process of finding the difference is largely dependent on reflective properties. The light scanner preferably emits infrared light.

One initial embodiment of the turnstile provides that the blocking position of the barrier arm be in the middle of the detection range of the optical electronic sensor. In this case, the optical electronic sensor includes two light scanners, whose detection beams are at a small angle on both sides of the barrier arm. This embodiment has the added advantage that the direction of passage can easily be reversed, so that such a turnstile can be used for entries and exists by simply reversing the controls. In each case, the turnstile drive is only put into operation when the first light scanner in the direction of passage responds; on the other hand, if the second light scanner responds first, a brake can be activated.

A turnstile released on the basis of a positive check should be set in rotation by the user as soon as he is ready to go through it, so that the motor is then driven at the expected time. With the turnstile in WO-A 93/03251, therefore, after pressing on the barrier arm of the released turnstile first, only a turning on a small angle takes place in a subsequent stop position, so residual resistance must be overcome. The user then moves forward, and another outer activation of the barrier arm then allows the drive motor to turn the turnstile until the next barrier arm is in the blocking position.

This type of control can also be achieved with the turnstile in the invention, if the turnstile has a stop position at an angle after the blocking position, and if the optical electronic sensor is arranged in the direction of passage behind the barrier arm in the blocking position in the angle between the blocking position and the stop position.

Since such an arrangement of a single light scanner behind the barrier arm in the blocking position prevents the light scanner from responding to a user standing in front of the barrier arm, there is a process in the invention for controlling the turnstile when a positive check sets the drive motor in operation, so that the barrier arm is turned out of the blocking position into the subsequent stop position, in which the detection beam of the light scanner can detect the user, and the barrier arm, because of a recognition signal by the light scanner, is turned past the stop position, until the next barrier arm is in the blocking position. Since the barrier arm does not have to be activated in either the blocking position or the stop position, the turnstile can let through skiers and small children and adults on slightly elevated ground without no difficulty.

A direct current motor that can be short-circuited in the stop position is used to drive the turnstile. Preferably, a worm wheel is also arranged on the drive shaft, into which a non-inhibiting worm fits, on whose shaft there is a magnetic brake and a device for determining the direction of rotation driven by the motor via a tractive mechanism.

The invention will be explained in greater detail below using the figures in the enclosed drawings, but is not limited to them.

Figure 2:
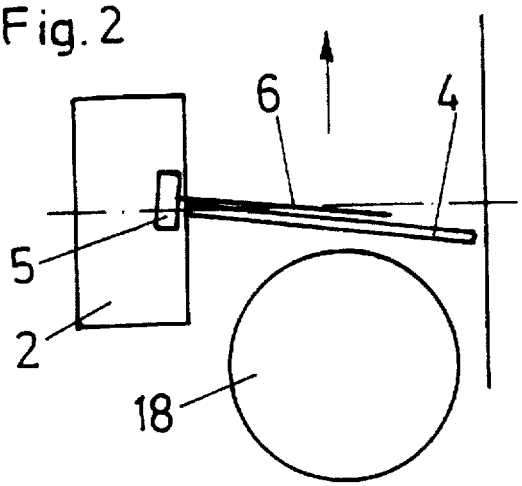
Figure 3:
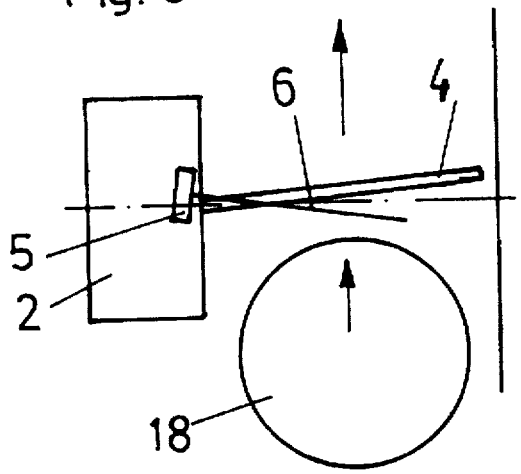
Figure 4:
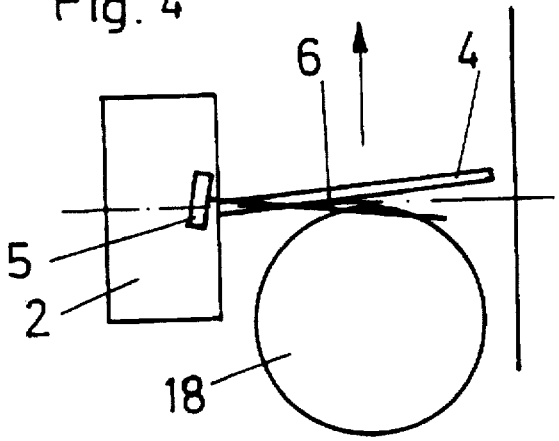
Figure 5:
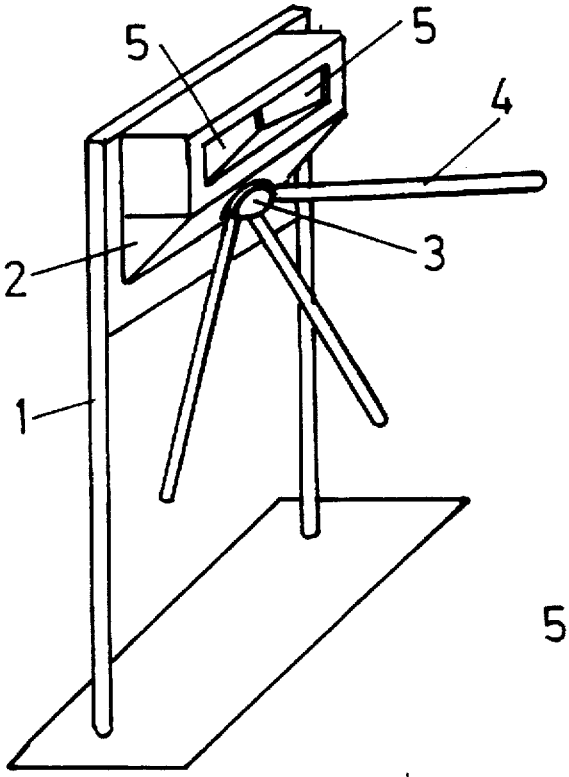
Figure 6:
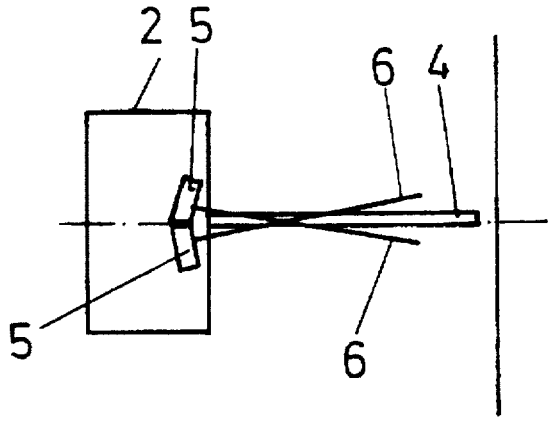
Figure 7:
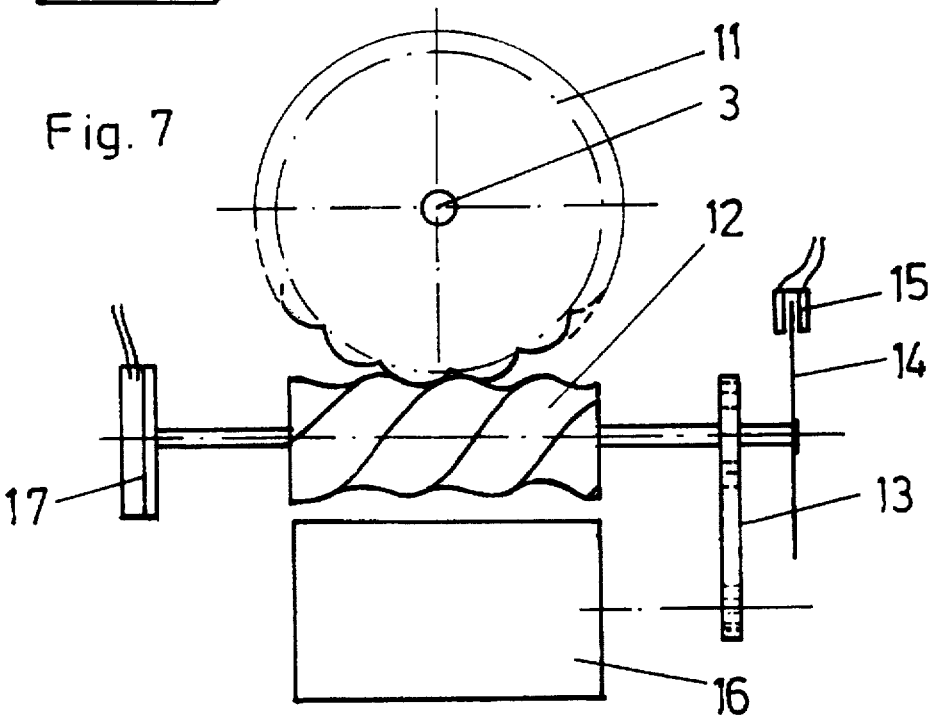

FIG. 1 shows an angled view of a first example of embodiment of the turnstile, FIG. 2 a schematic top view of one blocking position, FIG. 3 a schematic top view of a stop position, FIG. 4 a schematic top view of a user in the trigger position, FIG. 5 an angled view of a second example of embodiment of the turnstile, FIG. 6 a schematic top view of its blocking position, and FIG. 7 a schematic representation of the gear range.

The housing 2 of a turnstile 3 is arranged on a frame 1 so its height can be adjusted. The turnstile is assigned to a track, and has three barrier arms, of which the barrier arm 4 pointing up is in a blocking position, which is in an angle of roughly 10° in front of a center line drawn in dashes. As FIG. 7 shows, a worm wheel 11 is attached to the shaft of the turnstile 3, into which a non-inhibiting worm 12 fits, which is driven by an electric drive motor 16 via a tractive mechanism 13. The turnstile 3 is held in the blocked position of each barrier arm 4 by an electromagnetic brake 17, which grips the shaft of the worm 12. A disk 14 that recognizes the direction and angle of rotation is also arranged on this shaft with a detector 15 assigned to it. The turnstile also has an optical electronic sensor 5, via which the drive motor 16 is switched on and off, and in the embodiment in FIG. 1 to 4, a checking device 7, to which an environmentally shielded transmitting/receiving unit 8, a magnetic card reader 9 with a display 10 and a corresponding control circuit are assigned. The blocking position of the turnstile is shown in FIG. 2. A user 18 standing in front of the barrier arm 4 cannot be detected by the detection beam, since it is behind the-barrier arm. If the checking device 7 assigned to the turnstile 3 gives permission for passage through the track, the brake 17 is released and the drive motor 16 turns the respective barrier arm 4 out of the locked position into a stop position in which the motor 16 is stopped again. The turnstile turns only a few degrees here, in order to release the detection beam (FIG. 3). In the stop position, the brake 17 stays released. If the user 18 pushes it forward a little way, he is detected by the detection beam 6, as can be seen in FIG. 4, which then turns on the motor 16 of the turnstile. The motor turns the turnstile 3, releasing the passage until the next barrier arm 4 goes into the blocking position, in which the brake 17 is reactivated. An exact position of the barrier arm 4 in the blocking position and in the stop position is of subordinate significance. Thus, the blocking position or the stop position can be perpendicular to the direction of passage. Of course, intermediate positions are also conceivable.

In the embodiment in FIGS. 5 and 6, the turnstile is shown without a checking device 7. This type of turnstile 3, which has only one blocking position but no stop position is used at exits of sports facilities, in order to refuse unauthorized entry. The turnstile 3 has two optical electronic sensors 5 in the form of light scanners. Their detection beams 6 extend on both sides of the barrier arm 4 in the center. If the user approaches the turnstile from the right side, the first detection beam 6 responds to the user first, and the turnstile 3 is set in rotation. The motor stops if the second light scanner 5 does not respond within a period of time that is adjustable to the passage of the user. The direction of passage is predetermined, and if the user approaches from the second or wrong side, the second light scanner 5 reacts first. Since this is wrong, the motor remains stopped and the turnstile 3 locked. The direction of passage can easily be reversed, so that the turnstile can be used in both directions.

I claim:

1. A turnstile with a housing, a drive shaft, and barrier arms coming off it that are offset at an angle, each of which extends in a blocking position approximately at a right angle to a direction of passage, with an optical electronic sensor mounted in said housing, said sensor controlling a drive motor, which can be set in motion without contact by a signal of the optical electronic sensor in order to turn a next barrier arm of the turnstile into the blocking position, whereby the optical electronic sensor comprises two light beams which intersect to define a detection range including an angle of 20° maximum, said blocking position of the barrier arm being in the middle of said detection range.

2. A turnstile with a housing, a drive shaft and barrier arms coming off it that are offset at an angle, each of which extends in a blocking position as well as in a subsequent stop position approximately at right angles to a direction of passage, with an optical electronic sensor mounted in said housing, said sensor controlling a drive motor, which can be set in motion without contact in order to turn the barrier arm from the blocking position a few degrees into the subsequent stop position and, according to a signal of the optical electronic sensor, the next barrier arm of the turnstile into the blocking position, whereby the optical electronic sensor comprises a light beam extending in the direction of passage behind the blocking position and before the subsequent stop position of the barrier arm.

3. A turnstile according to one of claim 1, characterized by the fact that the optical electronic sensor includes at least one light scanner, which responds to reflective changes in a light beam that is emitted and is equipped with an outside-light and background filter.

4. A turnstile according to claim 3, characterized by the fact that the light scanner emits infrared light.

5. A turnstile according to claim 1, characterized by the fact that there is a worm wheel on the drive shaft, into which a non-inhibiting worm fits, on whose shaft there is a magnetic brake and a device that recognizes the turning direction, and the motor is driven by a traction mechanism.

6. A turnstile according to claim 2, characterized by the fact that the optical electronic sensor includes at least one light scanner, which responds to reflective changes in a light beam that is emitted and is equipped with an outside-light and background filter.

7. A turnstile according to claim 2, characterized by the fact that the light scanner emits infrared light.

8. A turnstile according to claim 2, characterized by the fact that there is a worm wheel on the drive shaft, into which a non-inhibiting worm fits, on whose shaft there is a magnetic brake and a device that recognizes the turning direction, and the motor is driven by a traction mechanism.

* * * * *